US005186818A

United States Patent [19]

Daage et al.

[11] Patent Number: 5,186,818

[45] Date of Patent: Feb. 16, 1993

[54] CATALYTIC PROCESSES

[75] Inventors: Michel Daage, Yardley, Pa.; Russell R. Chianelli, Somerville, N.J.

[73] Assignee: Exxon Research and Engineering Company, Florham Park, N.J.

[21] Appl. No.: 743,957

[22] Filed: Aug. 12, 1991

[51] Int. Cl.[5] ..... C10G 45/00; C10G 45/02; C10G 45/04

[52] U.S. Cl. ..... 208/254 H; 208/209; 208/213; 208/216 R; 208/215; 208/216 PP

[58] Field of Search ..... 208/216 R, 254 H

[56] References Cited

U.S. PATENT DOCUMENTS

| | | | |
|---|---|---|---|
| 4,626,339 | 12/1986 | Chianelli et al. | 208/216 R |
| 4,663,023 | 5/1987 | McCandlish | 208/216 R |
| 4,668,376 | 5/1987 | Young et al. | 208/216 R |
| 4,698,145 | 10/1987 | Ho et al. | 208/216 R |
| 4,740,295 | 4/1988 | Bearden, Jr. et al. | 208/216 R |

OTHER PUBLICATIONS

Kemp, et al., "Stacking of Molybdenum Disufide Layers in Hydrotreating Catalysts", Proceedings of the 9th International Congress on Catalysis, vol. I, pp. 125-135, Editors M. J. Phillips and M. Ternan, The Chemical Institute of Canada (1988).

*Primary Examiner*—Helane Myers
*Attorney, Agent, or Firm*—Joseph J. Dvorak

[57] ABSTRACT

The hydrotreating of petroleum feedstock is improved by using a layered transition metal catalyst, a mixture of such catalysts or a stocked bed of transition metal catalysts that has a selected ratio of edge to rim sites sufficient to provide a product having a predetermined sulfur and nitrogen content.

In another aspect of the present invention, there is provided a method for selecting a transition metal catalyst system for use in hydrotreating nitrogen and sulfur containing feedstocks to provide a hydrotreated product having a predetermined nitrogen and sulfur content and at a predetermined reaction residence time, which method comprises: selecting the amount of sulfur and nitrogen to be removed from a given feedstock by hydrotreating to obtain a product having a predetermined nitrogen and sulfur content; determining the variation in the reaction kinetics for sulfur and nitrogen removal of the given feedstock by hydrotreating with a transition metal catalyst of varying edge to rim ratios; selecting, for a predetermined reaction residence time, that ratio from the varying edge to rim ratios of the transition metal catalyst that provides the requisite sulfur and nitrogen removal to provide the product of predetermined sulfur and nitrogen content.

10 Claims, 12 Drawing Sheets

$$\frac{r}{r+e} = \frac{2.\pi d}{n.\pi d} = 0.40$$

CATALYTIC PROCESSES

FIELD OF THE INVENTION

The present invention relates to improvements in catalytic processes. More particularly, the present invention is concerned with improvements in catalytic processes, such as hydrotreating of petroleum feedstocks, using transition metal sulfide catalyst.

BACKGROUND OF THE INVENTION

Layered catalysts, such as transition metal catalysts, are well known catalysts that have a wide range of applications. For example, transition metal catalysts are useful in hydrotreating petroleum feedstocks to remove heteroatoms in the feed, like sulfur, oxygen and nitrogen, and transition metal catalysts can be used in hydrogenation processes, alcohol synthesis from syngas, hydrodemetallization of heavy crudes, catalytic hydrovisbreaking and the like.

The activity and, indeed, the selectivity of transition metal sulfide catalysts vary widely. However, achievement of multiple product targets can cause problems. For example, there has been a wide variety of sulfur containing molybdenum and tungsten catalysts that have been reported as useful in hydroprocessing petroleum feedstocks containing heteroatoms such as sulfur, oxygen and nitrogen. Because these catalysts display differences in selectivity, it has been generally necessary in hydrotreating these heteroatom containing petroleum feedstocks to overtreat the feedstock in order to obtain a treated product having a predetermined sulfur and nitrogen content. For example, it may be necessary to remove more nitrogen than is necessary to obtain a product with the desired sulfur content. This is particularly disadvantageous because it does not permit precise control over the sulfur and nitrogen levels in the treated product. It is also economically undesirable because of the excess hydrogen consumed in overtreating the feed, as well as the increased time and energy expended in achieving the desired product composition. Thus, there remains a need to improve transition metal catalyzed hydrotreating processes whereby a predetermined level of reduction of sulfur and nitrogen in the feedstock can be achieved with greater efficiency and/or less hydrogen consumption.

SUMMARY OF THE INVENTION

It has now been discovered that there is a relationship between the morphology of layered catalysts and the selectivity of those catalysts in catalytic processes, especially hydrotreating processes.

Basically, it is now believed that there are two types of catalytically active sites in transition metal sulfide catalyst that contribute to the selectivity of such a catalyst in hydrodesulfurization and hydrodenitrogenation and that they can be controlled by controlling crystallite morphology through application of synthetic techniques. These two sites are referred to herein as "edge" sites and "rim" sites. Accordingly, the hydrotreating of petroleum feedstock is improved by using a layered transition metal catalyst, a mixture of such catalysts or a stacked bed of transition metal catalysts that has a selected ratio of edge to rim sites sufficient to provide a product having a predetermined sulfur and nitrogen content.

In another aspect of the present invention, there is provided a method for selecting a transition metal catalyst system for use in hydrotreating nitrogen and sulfur containing feedstocks to provide a hydrotreated product having a predetermined nitrogen and sulfur content and at a predetermined reaction residence time, which method comprises: selecting the amount of sulfur and nitrogen to be removed from a given feedstock by hydrotreating to obtain a product having a predetermined nitrogen and sulfur content; determining the variation in the reaction kinetics for sulfur and nitrogen removal of the given feedstock by hydrotreating with a transition metal catalyst of varying edge to rim ratios; selecting, for a predetermined reaction residence time, that ratio from the varying edge to rim ratios of the transition metal catalyst that provides the requisite sulfur and nitrogen removal to provide the product of predetermined sulfur and nitrogen content.

These and other embodiments of the present invention will be more readily understood upon reading of the "Detailed Description of the Invention" in conjunction with the accompanying drawings.

DETAILED DESCRIPTION OF THE INVENTION

The present invention is based on the discovery that there are basically two types of sites in layered transition metal catalysts that influence the selectivity of the catalyst toward hydrodenitrogenation (HDN) and hydrodesulfurization (HDS). These sites are called edge and rim sites. The nature of these sites may be better appreciated by reference to FIGS. 1 and 2.

Figure 1:
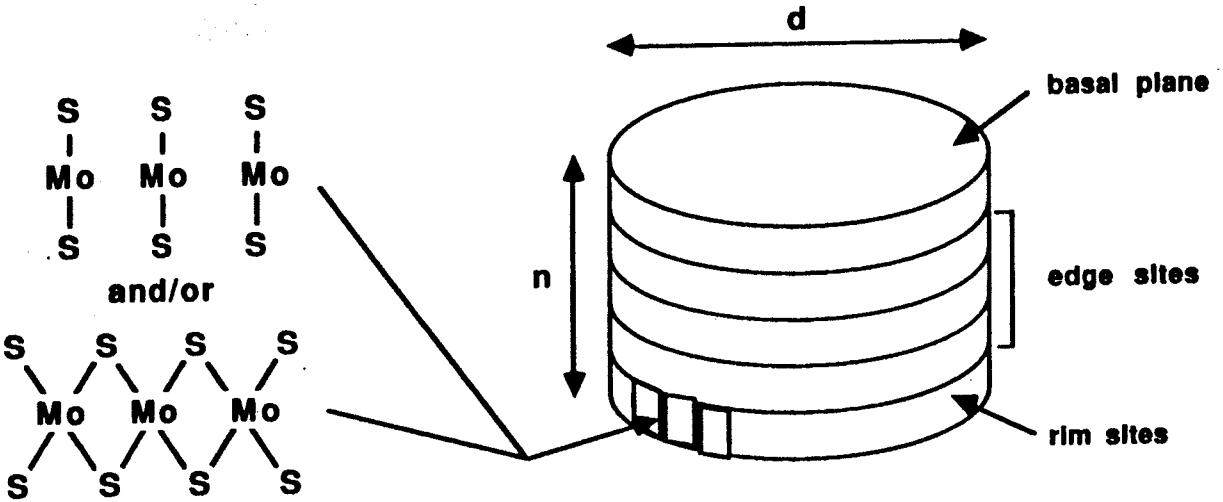
FIG. 1 is a conceptual model of a $MoS_2$ catalyst particle.

In FIG. 1, there is shown a conceptual physical model of a layered transition metal sulfide catalyst, $MoS_2$. As shown, the catalyst consists of a stack of six layers of $MoS_2$. Of the six layers, there are two rim layers; i.e., layers that have their basal plane exposed. The basal planes consist essentially of a closely packed layer of sulfur atoms and are catalytically inactive. Also, there are four edge layers, the edge layers being sandwiched between two other layers (rim or edge). Edge layers do not have their basal plane or any significant fraction of it exposed. Single crystal molybdenum sulfide would tend to have structures similar to the idealized structure shown in FIG. 1. The rim sites and the edge sites consist of the ensemble of molybdenum atoms and sulfur atoms that terminate the borders of the rim and edge layers. As highlighted in FIG. 1, the molybdenum atom can be associated to two singly bonded sulfur atoms (terminal sulfur) or to four bridged sulfur atoms that are shared with the neighboring molybdenum atom of the border. The local structures of these ensembles may be identical, whether the site belongs to a rim or an edge layer. The rim site is, therefore, defined by these particular ensembles being located on the border of a rim layer. Similarly, the edge sites are the ensembles located on the border of an edge layer. It is the location of the Mo-S ensemble on the surface of the catalyst particle which matters and not the composition of the ensemble itself.

Figure 2:
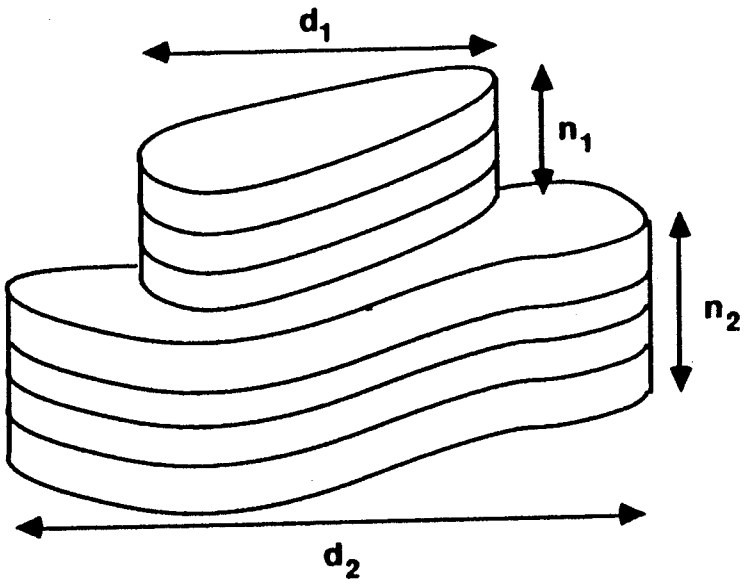
FIG. 2 is a conceptual model of yet another $MoS_2$ catalyst particle.

Referring to FIG. 2, there is shown a less idealized model of molybdenum sulfide. In FIG. 2, it can be seen that there is one layer that is partially sandwiched between two edge layers. In that particular case, a significant fraction of the basal plane near the border of the layer is being exposed. Such a layer is, therefore, defined as a rim layer. The $MoS_2$ particle shown in FIG. 2 consists of three rim layers and four edge layers.

In the two models shown, the relative concentration of rim sites to edge sites is a function of the stacking height or the number of layers in the layered catalyst particle.

It is a key feature of the present invention to take advantage of the relationship between a transition metal catalyst's morphology; i.e., its edge to rim ratio, and its selectivity to optimize processes employing the catalyst. To do so, it is necessary then to first determine the approximate edge to rim ratio. This can be accomplished very simply by at least one of the two methods discussed below.

The relative proportion of rim and edge sites can be calculated using the simple model illustrated, for example, in FIG. 1. This model assumes, of course, that the catalyst particles consist of disks n layers thick and of a diameter d. Top and bottom layers have rim sites, while layers in the middle only have edge sites. The top surface of the disk is the basal plane, which is known to be catalytically inert. In this case, the relative density of rim and edge sites can be deduced from the following expression:

$$\frac{r}{r+e} \quad \frac{2 \cdot \pi d}{n \cdot \pi d} = \frac{2}{n} \qquad \text{Equation 1}$$

where r is the number of rim sites and e is the number of edge sites. It is important to note that this relative density does not depend upon the particle diameter or shape, but only on the stacking. For the particle shown in FIG. 2, the relative density is estimated by using the following expression:

$$\frac{r}{r+e} = \frac{2 \cdot (\pi d_2 + \pi d_1)}{n_1 \pi d_1 + n_2 \pi d_2} \qquad \text{Equation 2}$$

As indicated previously, there is a relationship between the density of rim to edge sites or the morphology of a layered transition metal catalyst and the catalytic selectivity. Therefore, determining the relative ratio of edge to rim sites in layered transition metal catalysts is an important first step in tailoring hydrotreating processes to achieve a predetermined result. Importantly, it has been discovered that a precise measurement of the relative ratio of edge to rim sites is not necessary in order to improve hydrotreating processes. Indeed, it is sufficient to determine an average ratio of edge to rim sites in order to adjust the ratio to produce a predetermined result in hydrotreating a feedstock.

There are two convenient ways for obtaining a sufficient indication of edge to rim ratio in layered transition metal sulfide particles. One of these is based on x-ray crystallography; the other is based on the selectivity displayed by a given transition metal sulfide in an actual catalytic process.

Figure 3:
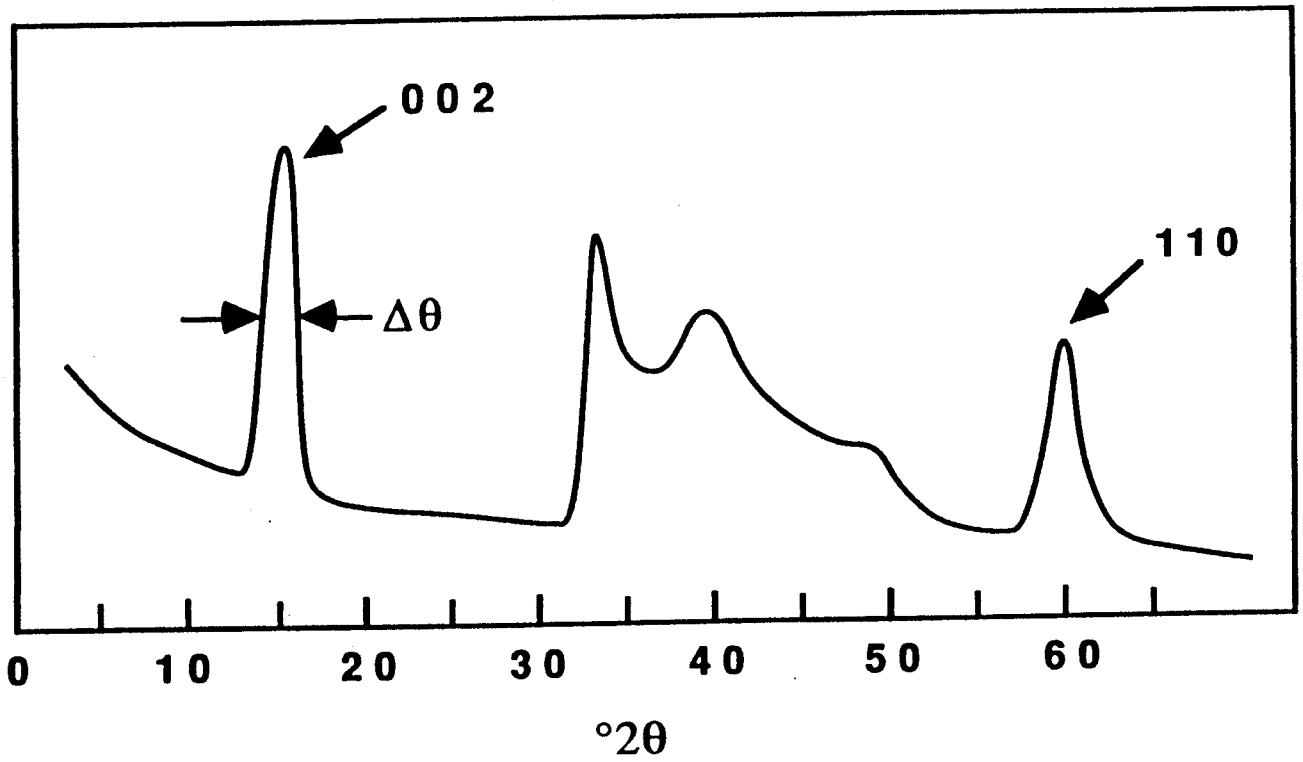
FIG. 3 is a description of a characteristic x-ray diffraction pattern of a poorly crystalline $MoS_2$.

It is well known that x-ray diffraction line broadening analysis can determine crystallite size using the Debye-Scherrer equation shown below:

$$h = 2\pi \sin \theta / \lambda \Delta\theta \qquad \text{Equation 3}$$

where $\Delta\theta = (\Delta\theta_{measured} - \beta)$ and $\beta = 0.2\ ^\circ 2\ \theta$ A unique x-ray diffraction peak can be associated with a specific set of crystal lattice plane. In the case of $MoS_2$, the planes associated with the layers are called 002 planes. The stack height can be determined by applying Equation 3 to the measured x-ray diffraction 002 peak, observed around 15° 2$\theta$ (FIG. 3).

As indicated previously, an alternate method for obtaining a useful approximation of edge to rim ratio in a given transition metal catalyst is by direct measurement of catalyst selectivity, using catalysts having the same chemical composition, but different edge to rim ratios. Below, this technique will be illustrated using the hydrogenation and the desulfurization of a model compound, dibenzothiophene (DBT).

Figure 4:
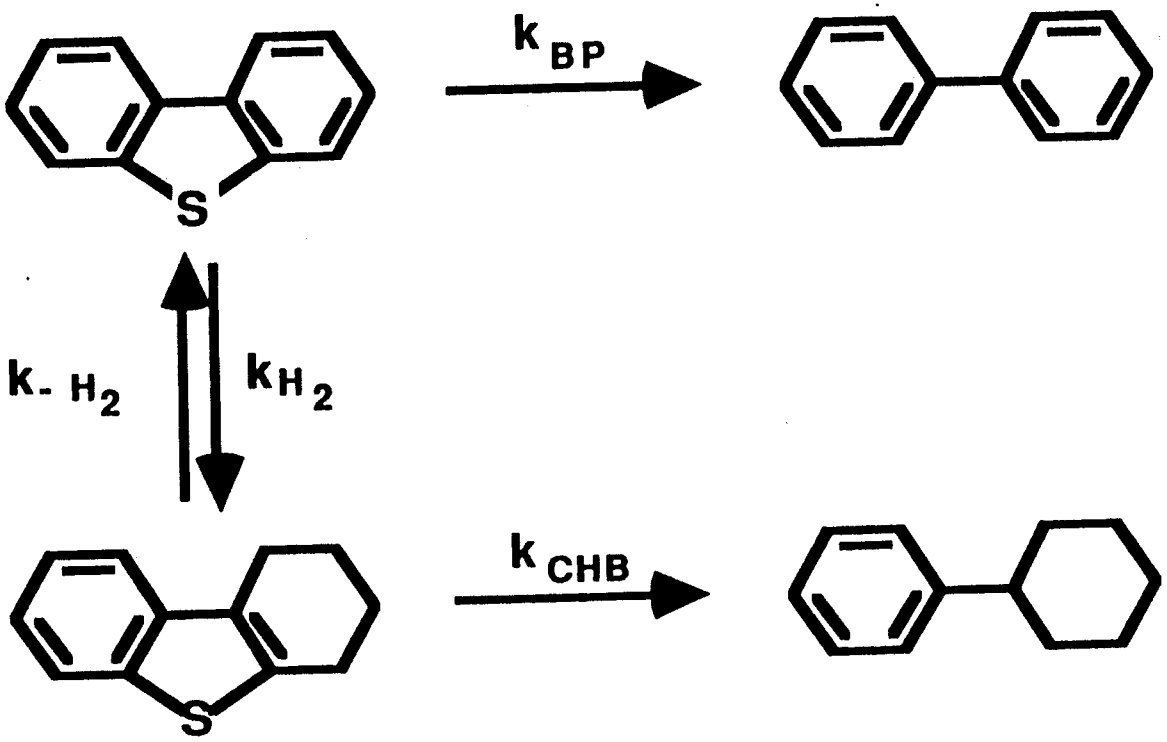
FIG. 4 is a representation of the reaction pathways of dibenzothiophene.

Consider first the different reaction pathways that are possible in treating DBT with hydrogen in the presence of a transition metal sulfide catalyst, such as $MoS_2$. The possible pathways are shown in FIG. 4.

Indeed, using DBT as a model compound for testing the catalytic activity of $MoS_2$ resulted in two primary products being formed: tetrahydrodibenzothiophene (H4DBT) and biphenyl (BP). The reaction was carried out in a batch reactor designed to allow a constant hydrogen flow. Basically, the operating conditions were 1 to 2 grams of catalyst, 100 $cm^3$/min of hydrogen, 3000 kPa hydrogen, 350° C., 100 $cm^3$ feed and up to 7 hours contact times. The feed contained 0.4 wt. % sulfur as DBT. The product analysis was performed on a HP5880 gas chromatograph equipped with a 75% OV1-25% Carbowax 20M fused silica column. The hydrodibenzothiophene was identified by mass spectrometry.

In using microcrystalline $MoS_2$, the hydrodesulfurization of DBT is favored, but not its hydrogenation. This is in stark contrast to disordered powders which exhibit both reactions in varying degrees. The disordered powders, of course, have a high number of rim sites; whereas, the ordered crystalline materials have few rim sites plus edge sites. Stated differently, the rate of formation of BP is proportional to the rim plus edge sites; whereas, the rate of formation of H4DBT, which is a hydrogenation reaction, i.e., a necessary step in the hydrodenitrogenation process, is proportional to the rim sites. Thus, $$\frac{k_{H2}}{k_{BP}} = A \cdot \frac{r}{r+e} A \cdot \frac{2}{n} \qquad \text{Equation 4}$$

where n is the average number of layers in the catalyst or the stack height and A is a constant representing the ratio of the turnover frequencies of the two reactions. This relationship between selectivity and morphology may be better appreciated by reference to FIG. 5.

Figure 5:
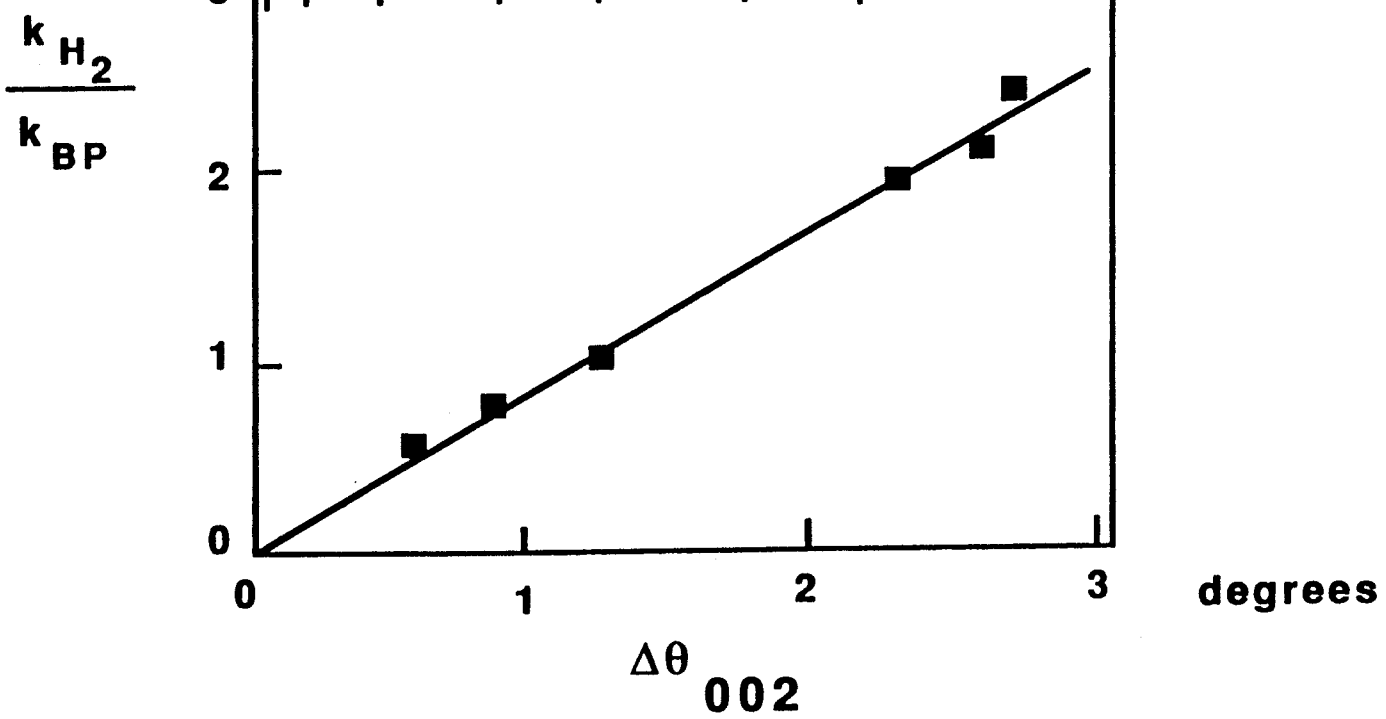
FIG. 5 is a graph showing the relationship between the HDS selectivity of a catalyst and its x-ray diffraction.

FIG. 5 shows the linear relation between the selectivity, expressed as the ratio of the rate of hydrogenation to the rate of desulfurization, with the width of the 002 x-ray diffraction peak. As mentioned above, the width of the 002 peak can be converted to the average number of stacked layers of the catalyst by using the Debye-Scherrer equation. This conversion has been applied to the experimental data in order to obtain the axis using the number of layers (on top of the graph). Furthermore, the slope of this linear plot can be used to estimate the constant A and a value of 3.684 is obtained. Thus, $$n = 7.367 \times \frac{k_{BP}}{k_{H2}} \qquad \text{Equation 5}$$

As will be readily appreciated, in hydrotreating a feedstock containing both nitrogen and sulfur compounds with layered transition metal catalysts, various interactive effects occur which impact on the overall result achieved. Therefore, after determining the relative ratio of rim to edge in the catalyst, the competitive adsorption properties of that catalyst must be determined. This can be done by using the Langmuir-Hinshelwood kinetic model, as expressed by the following equation:

$$R_i = k_i \frac{K_1[C_i]}{1 + \Sigma_i K_i[C_i]} \qquad \text{Equation 6}$$

where $R_i$ is the reaction rate of compound i, $k_i$ is the rate constant for that particular reaction, $K_i$ is the adsorption constant of compound i and $[C_i]$ the concentration of compound i. Indeed, the relative adsorption constants can be determined from a simplified form of the Langmuir-Hinshelwood equation. In hydrotreating conditions, high coverage of the catalyst surface is obtained. Thus, the term 1 in denominator is small and can be neglected. When two active species (X, Y) are present in the feed, the rate of disappearance of one species (X) is inhibited by the presence of the other (Y). For a given mixture of these two species, relative rates ($R_i/R_O$) can then be expressed as the ratios of the rate observed with the mixture (X+Y) to the rate of the pure compound (X) as described by the following equation:

$$\frac{R_i}{R_o} = \frac{K_x[C_x]}{K_x[C_x] + K_y[C_y]} = \frac{1}{1 + \frac{K_y[C_y]}{K_x[C_x]}} \qquad \text{Equation 7}$$

where $K_x$ and $K_y$ are the adsorption constants for compounds X and Y, respectively, and $[C_x]$ and $[C_y]$ are the concentrations of compounds X and Y, respectively. From this simplified equation, the relative adsorption constant ($K_y/K_X$) can be extracted. The relative adsorption constant, of course, is characteristic of each type of catalytic site (i.e., rim and edge) and may not be related to the total adsorption properties of the catalyst. This is the case, for example, when a supported catalyst is used: adsorption of molecules on noncatalytic sites present on the support surface will occur, but this does not modify the competitive adsorption on the catalytic sites.

From the relative adsorption constants, it is now possible to determine the reaction kinetics for the hydrodesulfurization and hydrodenitrogenation of a nitrogen and sulfur containing feedstock for each of a series of catalysts having different edge to rim ratios. This is readily achieved by integrating the relevant equations, 8 and 9, for HDS and HDN, respectively.

$$R_{HDS} = k_{HDS} \frac{(1 - C_r)}{1 + K_E \frac{[S]}{[N]}} \qquad \text{Equation 8}$$

$$R_{HDN} = k_{HDN} \frac{C_r}{1 + \frac{1}{K_R} \frac{[N]}{[S]}} \qquad \text{Equation 9}$$

In these equations, $K_E$ and $K_R$ are the relative adsorption constants for N relative to S on the edge and rim sites, respectively, and $C_r$ represents the relative concentration of rim sites. These equations describe the competitive adsorption of the nitrogen and sulfur containing molecules in the feed, according to the Langmuir-Hinshelwood kinetics.

After calculating the variation of HDS and HDN kinetics with varying rim to edge ratio catalysts, a catalyst having a rim to edge ratio sufficient to yield a product, under hydrotreating conditions, that has a predetermined amount of sulfur and nitrogen compounds, is then selected, with consideration given, of course, to the appropriate residence time and, hence, the amount of hydrogen consumption. In this regard, see Examples 4 to 6 and the accompanying figures.

It should be readily appreciated that if a given catalyst does not have the requisite rim to edge ratio, a mixture of catalysts having the requisite rim to edge ratio may be selected and used to effect the hydrotreating. Additionally, a stacked bed of transition metal catalysts that provide, on average, the requisite rim to edge ratio can be selected and used in the hydrotreating of a feedstock.

The conditions employed for hydrotreating, using a catalyst selected in accordance with this invention, will vary considerably, depending on the nature of the hydrocarbon being treated and, inter alia, the extent of conversion desired. In general, however, the following table illustrates typical conditions for hydrotreating a naphtha boiling within a range of from about 25° C. to about 210° C., a diesel fuel boiling within a range of from about 170° C. to 350° C., a heavy gas oil boiling within a range of from about 325° C. to about 475° C., a lube oil feed boiling within a range of from about 290° C. to 550° C., or residuum containing from about 10 percent to about 50 percent of a material boiling above about 575° C.

Typical Hydrotreating Conditions

| Feed | Temp., °C. | Pressure psig | Space Velocity V/V/Hr. | Hydrogen Gas Rate SCF/B |
|---|---|---|---|---|
| Naphtha | 100–370 | 150–800 | 0.5–10 | 100–2000 |
| Diesel Fuel | 200–400 | 250–1500 | 0.5–4 | 500–6000 |
| Heavy Gas Oil | 260–430 | 250–2500 | 0.3–2 | 1000–6000 |
| Lube Oil | 200–450 | 100–3000 | 0.2–5 | 100–10000 |
| Residuum | 340–450 | 1000–5000 | 0.1–1 | 2000–10000 |

EXAMPLES

Example 1

$MoS_2$ Powder

In this example, an ammonium thiomolybdate $(NH_4)_2MoS_4$ catalyst precursor was decomposed under flowing $H_2S/H_2$ (15%) for 2 hours at 350° C. The resulting $MoS_2$ catalyst (80 $m^2/g$) was pressed under 15,000–20,000 psi and then meshed through 20/40 mesh sieves. One gram of this meshed catalyst was mixed with 10 g of 1/16-in spheroid porcelain beads and placed in the basket of a Carberry-type autoclave reactor. The remainder of the basket was filled with more beads. The reactor was designed to allow a constant flow of hydrogen through the feed and to permit liquid sampling during operation.

100 cc of a feed comprising a DBT/Decalin mixture, which was prepared by dissolving 4.4 g of dibenzothiophene (DBT) in 100 cc of hot decalin, was loaded in the reactor vessel. The solution thus contained about 5 wt. % DBT or 0.8 wt. % S. The basket, containing the catalysts was then immersed in the feed. The autoclave was closed and hydrogen flow was initiated at the rate of 100 cc/min. The hydrogen pressure was increased to about 450 psig and the temperature in the reactor raised from room temperature to 350° C. over a period of ½ hour. The hydrogen flow rate was maintained at 100 cc per minute. When the desired temperature and pressure were reached, a GC sample of liquid was taken and additional samples taken at one hour intervals thereafter. The liquid samples from the reactor were analyzed using a HP5880 capillary gas chromatograph equipped with a flame ionization detection.

As the reaction progressed, samples of liquid were withdrawn once an hour and analyzed by GC. in order to determine the activity of the catalyst towards hydrodesulfurization, as well as its selectivity for hydrogenation. The formation of biphenyl (BP) was used to determine the activity associated to the total rim+edge sites of the catalysts and the formation of tetrahydrodibenzothiophene (H4DBT) was used for the rim sites only. The rate constants for these two reactions were estimated by using a Runge-Kutta integration of the Langmuir-Hinshelwood kinetics. It is assumed that the adsorption constant of DBT and H4DBT are the same.

For this particular $MoS_2$ catalyst, the rate constant for BP formation was $k_BP=12.0\times10^{16}$ molecules.$g^{-1}$.$s^{-1}$ and the rate constant for H4DBT was $kH2=29.0\times1016$ molecules.$g^{-1}$.$s^{-1}$. Using the relation between the stacking and the selectivity described in the invention, an average stacking (n) can be estimated. In this particular case:

$$n = 7.367 \times \frac{12.0}{29.0} = 3.1 \text{ layers}$$

The rate constants measured in that particular experiment are then used as the base case for the measurement of the relative adsorption constants; i.e., the rates measured in presence of a N containing compounds are normalized to the rates measured in absence of such compound.

The competitive hydrodesulfurization and hydrodenitrogenation of DBT and tetrahydroquinoline (14THQ) was carried out in a sequence similar to that of the hydrodesulfurization of DBT alone, with the exception of the composition of the feed. The feeds used were prepared by using the DBT/Decalin in which 0.8 wt. %, 0.3 wt. % and 0.1 wt. % N were added as 14THQ. As expected, both the hydrogenation reaction (production of H4DBT) and the desulfurization reaction (production of BP) were inhibited by the competitive adsorption of the N containing molecules, as illustrated by Table 1.

TABLE 1

| Wt. % N | $R_{BP}$ | $R_{H2}$ |
|---|---|---|
| None | 1.00 | 1.00 |
| 0.10 | 0.45 | 0.06 |
| 0.31 | 0.19 | 0.02 |
| 0.94 | 0.08 | 0.01 |

From the simplified Langmuir-Hinshelwood equation for binary mixtures, relative adsorption constants ($K_N^{BP}$ for the HDS sites and $K_N^{H}2$ for the hydrogenation sites) for N compared to S are obtained for both reactions. Thus, KNBP=4.5 and KNH2=50.

Example 2

Ni Promoted $MoS_2$ Powder

This experiment was similar to that in Example 1, except that the catalyst precursor was Nickel tris(ethylene diamine) thiomolybdate $Ni(H_3N(CH_3)2NH_3)$-$3MoS_4$. The precursor was treated and formed in the same sequence as $MoS_2$ powder described in Example 1.

For this particular $MoS_2$ catalyst, the rate constant for BP formation was $k_{BP}=46.9\times10^{16}$ molecules.$g^{-1}$.$s^{-1}$ and the rate constant for H4DBT was $k_{H2}=12.1\times10^{16}$ molecules.$g^{-1}$.$s^{-1}$. When using the relation between the stacking and the selectivity described in the invention, an average stacking (n) is estimated. Thus, $$n = 7.367 \times \frac{46.9}{20.1} = 17.2 \text{ layers}$$

However, in this particular case, i.e., a promoted molydenum disulfide, we are assuming that the factor A is the same than that of pure $MoS_2$. It is unlikely to be the case and, therefore, the average stacking is an apparent value that allows to compare the different catalysts. The apparent average stacking corresponds indeed to the stacking of a pure $MoS_2$ catalysts which would have the same selectivity as the promoted catalyst.

Table 2 summarizes the results obtained with the binary mixture of DBT and 14THQ:

TABLE 2

| Wt. % N | $R_{BP}$ | $R_{H2}$ |
|---|---|---|
| None | 1.00 | 1.00 |
| 0.15 | 0.31 | 0.04 |
| 0.35 | 0.17 | 0.02 |
| 0.71 | 0.10 | 0.01 |

The relative adsorption constants are KNBP=4.8 and KNH2=51.

Example 3

Alumina Supported Ni Promoted $MoS_2$ Catalysts

This experiment was similar to that in Example 1, except that the catalyst was a sample of a commercial hydrotreating catalyst: KF840. The catalyst pellets were ground and meshed through 20/40 mesh sieves. The catalyst was then treated in the same sequence as $MoS_2$ powder described in Example 1.

For this supported catalyst, the rate constant for BP formation was $k_{BP}=40.0\times10^{16}$ molecules.$g^{-1}.s^{-1}$ and the rate constant for H4DBT was $k_{H2}=26.0\times10^{16}$ molecules.$g^{-1}.s^{-1}$. When using the relation between the stacking and the selectivity described in the invention, an average stacking (n) is estimated. Thus, $$n = 7.367 \times \frac{40.0}{26.0} = 11.3 \text{ layers}$$

However, in this particular case, i.e., a promoted molydenum disulfide, we are assuming that the factor A is the same than that of pure $MoS_2$. It is unlikely to be the case and, therefore, the average stacking is an apparent value that allows to compare the different catalysts. The apparent average stacking corresponds indeed to the stacking of a pure $MoS_2$ catalysts which would have the same selectivity as the promoted catalyst.

Table 3 summarizes the results obtained with the binary mixture of DBT and 14THQ:

TABLE 3

| Wt. % N | $R_{BP}$ | $R_{H2}$ |
|---|---|---|
| None | 1.00 | 1.00 |
| 0.10 | 0.48 | 0.06 |
| 0.26 | 0.23 | 0.02 |
| 0.62 | 0.14 | n.a. |

The relative adsorption constants are $K_N BP=3.9$ and $K_N H_2=60$.

Example 4

Optimum Rim to Edge Ratio for the Desulfurization of a Low Nitrogen Containing Feed Such as LCCO Feedstock In this example, the variation of the desulfurization and the denitrogenation of a given feed has been simulated on a computer by integrating the relevant kinetic equations for HDS and HDN:

$$R_{HDS} = k_{HDS}\frac{(1 - C_r)}{1 + K_E\frac{[S]}{[N]}}$$

$$R_{HDN} = k_{HDN}\frac{C_r}{1 + \frac{1}{K_R}\frac{[N]}{[S]}}$$

These equations described the competive adsorption of the N and S containing molecules according to the Langmuir-Hinshelwood kinetics. The rate constant $k_{HDS}$ and $k_{HDN}$ are respectively chosen equal to $80\times10^{16}$ molecule/g/s and $7\times10^{16}$ molecule/g/s. These values are typical of commercial catalysts for the HDS of DBT and HDN of quinoline. $C_r$ represents the relative concentration of rim sites. $K_E$ and $K_R$ are the relative adsorption constant for N relative to S on the edge and rim sites, respectively. Typically, $K_E$ is equal to 4.5 and $K_R$ to 53, as measured in the preceding examples. [S] and [N] are the concentration of heteroatom in wt. % in the feed. In this particular example, the nitrogen concentration was 0.1 wt. % as Quinoline and the sulfur concentration was 0.8 wt. % as Dibenzothiophene.

Figure 6:
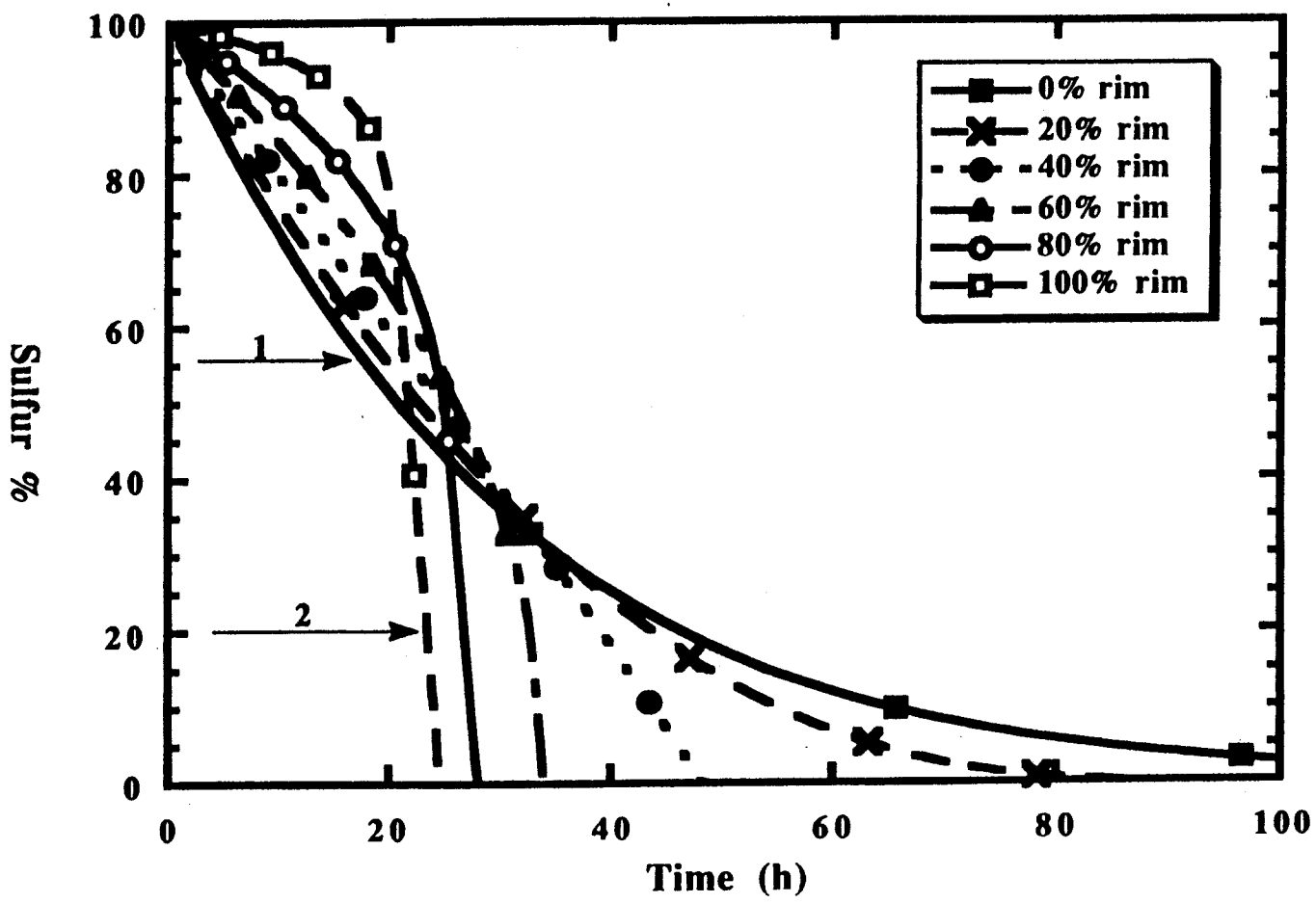
FIG. 6 is a graphic presentation of the variation of HDS kinetics with catalysts having different rim concentrations.

FIG. 6 shows the temporal variation of the kinetics for HDS for different relative concentrations of rim sites. The HDS kinetics is complex and the shape of the curve is highly dependent upon the rim concentration. The major characteristic is a crossover point between the curves for low rim catalysts and high rim catalysts. If a low HDS conversion is needed (FIG. 6, arrow 1), a catalyst with a maximum of edge sites is the most appropriate; whereas, a high rim catalyst should be used for a low sulfur target (FIG. 6, arrow 2). Consequently, an optimum rim to edge ratio exists for a process targeting specific S and N targets.

Figure 7A:
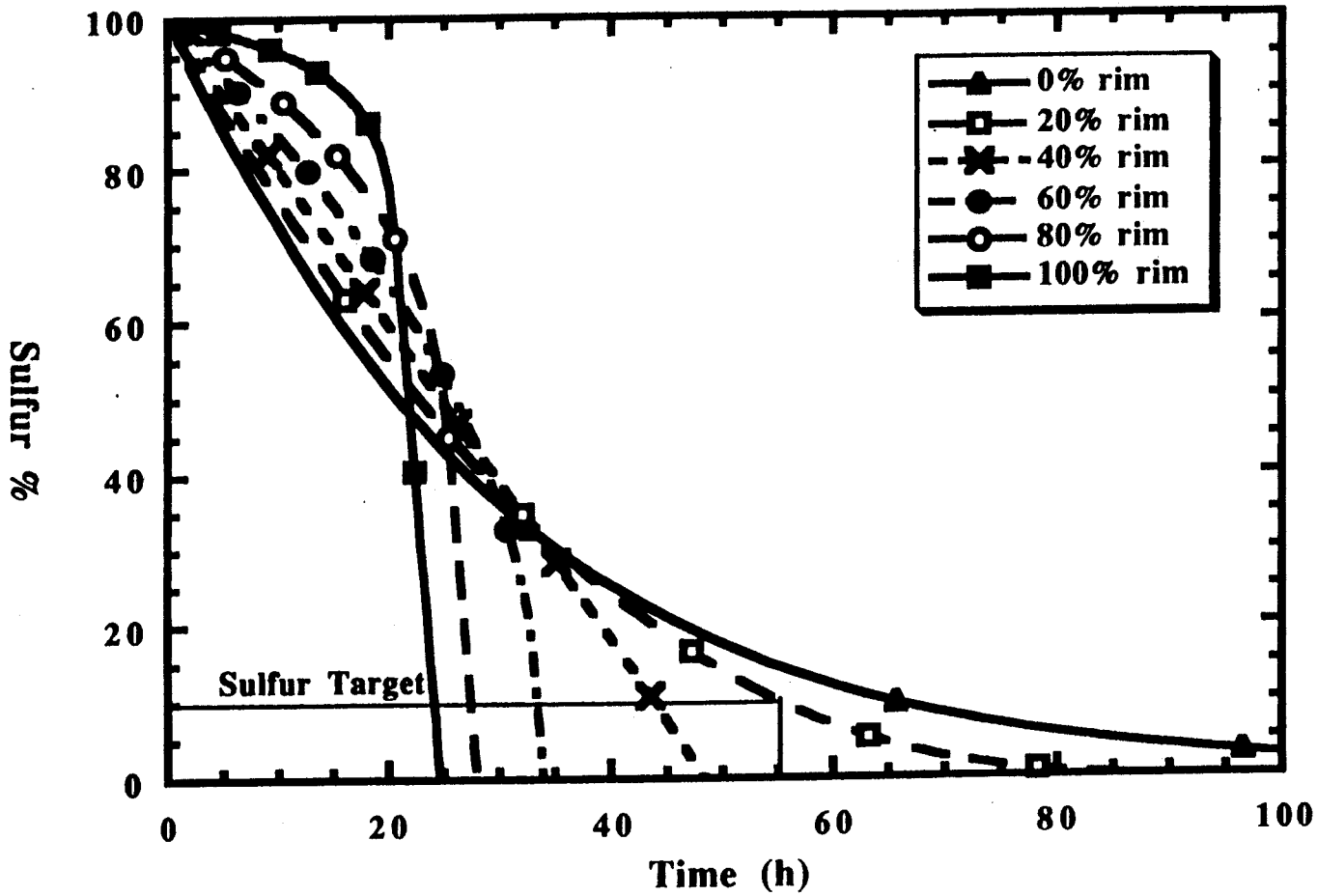
FIGS. 7*a* and 7*b* are graphic presentations of HDS and HDN kinetics with catalysts having different rim concentrations.
Figure 7B:
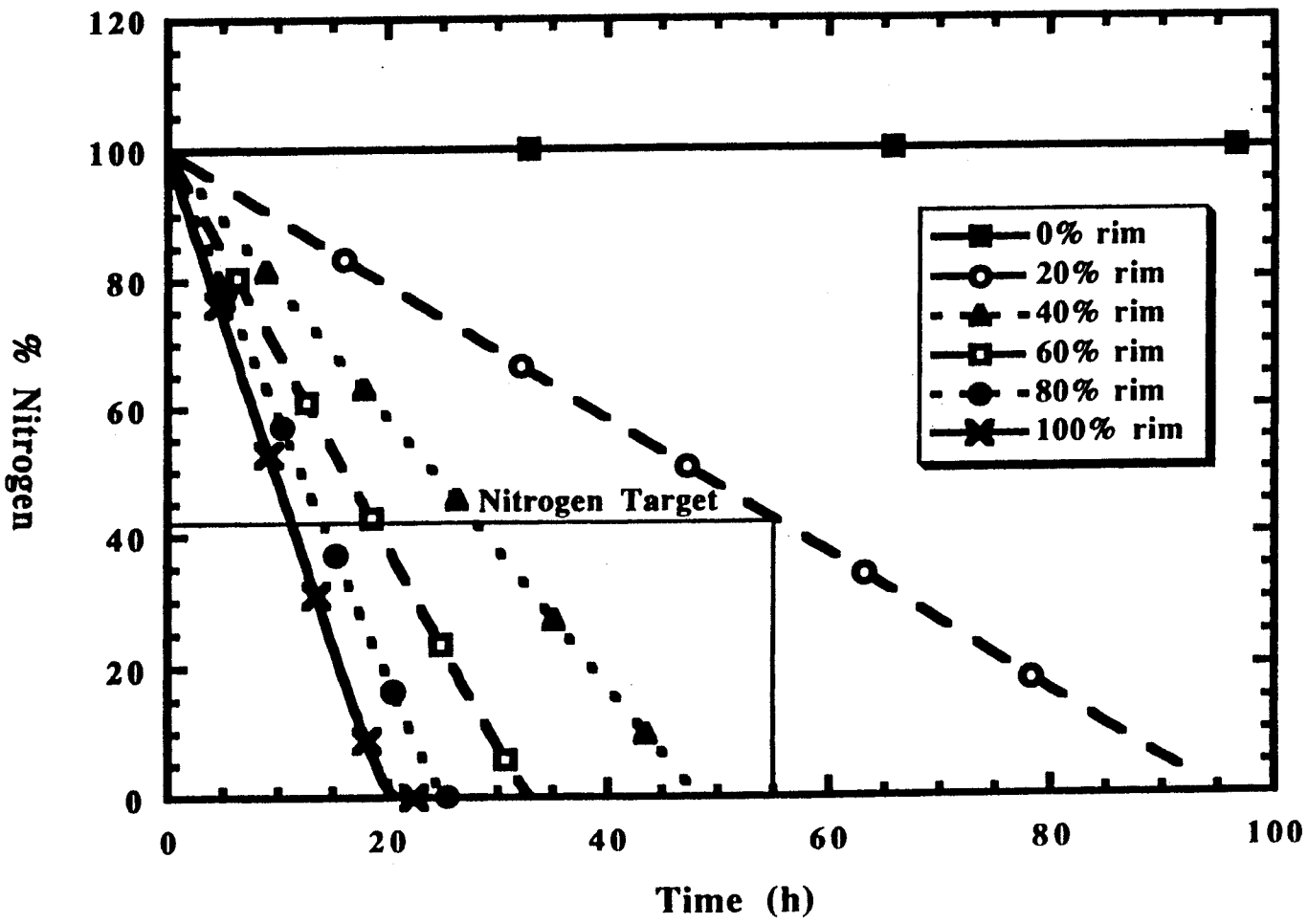
Figure 8A:
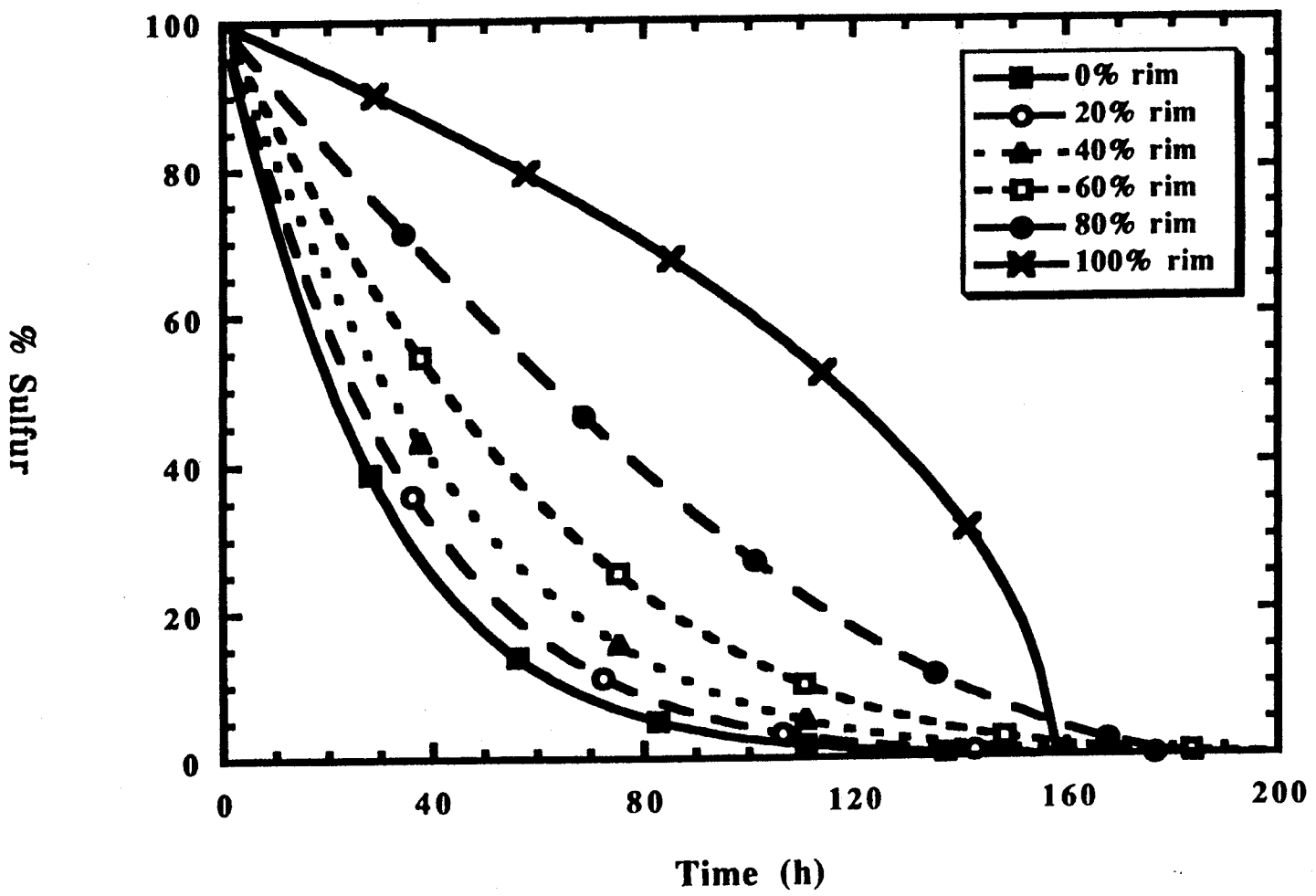
FIGS. 8*a* and 8*b* are graphic presentations similar to FIGS. 7*a* and 7*b*, but for a high nitrogen containing feed.
Figure 8B:
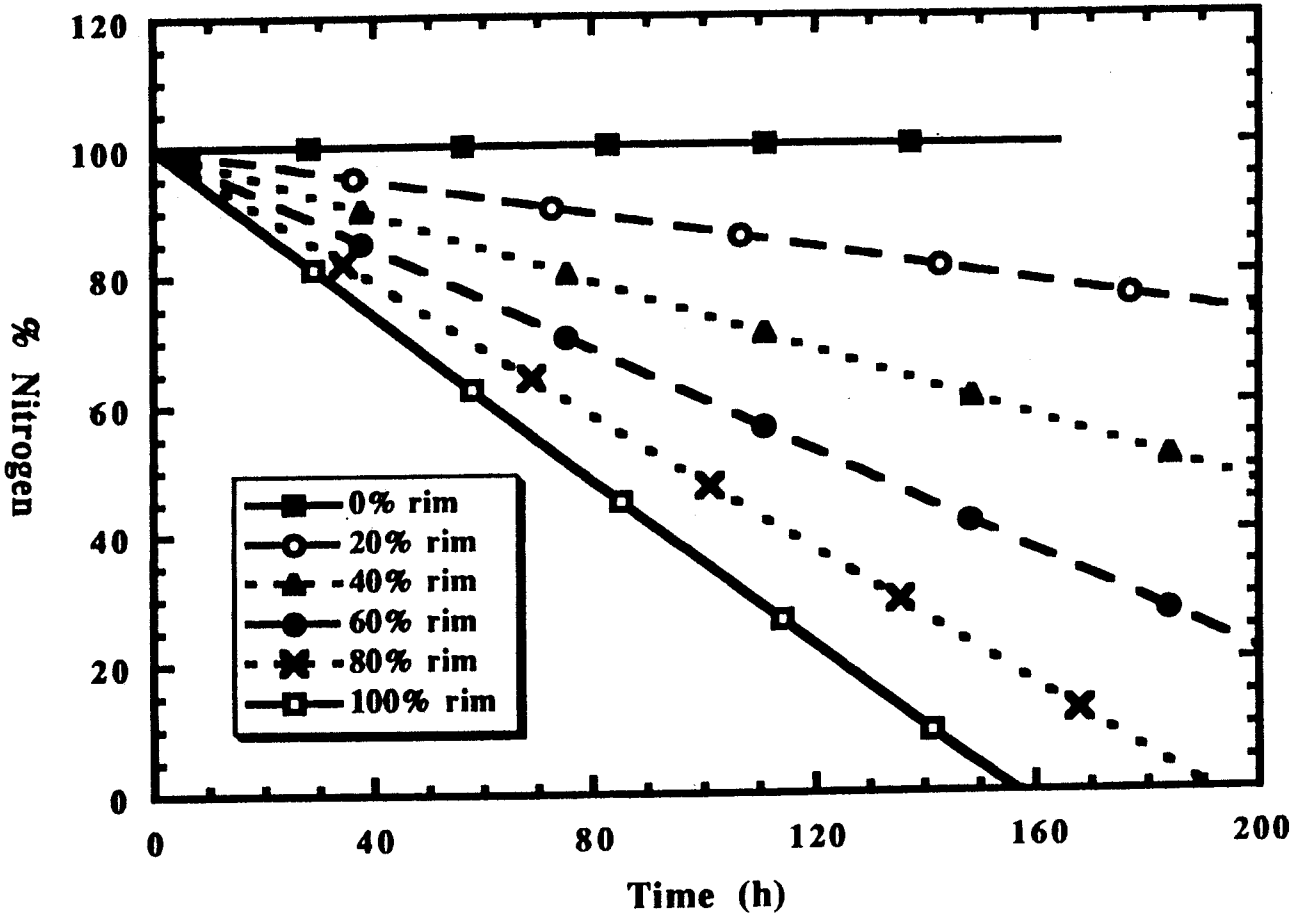

Moreover, other choices become more attractive if one considers the hydrogen comsumption of the process. As highlighted in FIG. **7*b*, the HDN follows a quasi linear variation and it is clear that the most efficient way of running the process to save hydrogen is to achieve both sulfur and nitrogen target without exceeding any one of them. For example, assume that a process is designed to obtain a product containing 800 ppm S (~90% HDS conversion) and 420ppm N (~42% HDN conversion). As shown in FIGS. 7*a* and 7*b*, the catalyst containing 100% rim is the most efficient, since less residence time will be required to meet the targets: ~24 h for the S target. The throughput of the reactor is, therefore, maximum. However, all the nitrogen would be removed and a large consumption of hydrogen will be obtained. Overtreating a feed by N removal is, therefore, costly. A better solution, particularly if the hydrogen consumption is critical, is to choose a catalyst containing 20% rim sites. It will require roughly twice the residence time in the reactor, but the hydrogen consumption will be minimum because both targets will be reached at the same time. According to FIGS. 7*a* and 7*b***, the residence time will be equal to 55 h.

Example 5

A VGO Like Feed

This example is similar to Example 4, but a higher nitrogen concentration has been used to simulate the kinetics relevant to heavier feed, such as VGO. The same kinetics equations have been used and the feed heteroatom contents were 0.8 wt. % S and 0.8 wt. % N. All the other parameters, such as the adsorption constants and rate constants, were identical to that of Example 4.

FIGS. **8*a* and 8*b*** show the temporal variation of the kinetics for HDS and HDN for different relative concentration of rim sites. The major feature here is that there are less changes in the shapes of the curves for the HDS reaction and the cross points only occur at very high level of HDS conversion. Consequently, it becomes clear that regardless of the S target, the catalyst with 100% rim sites is the most efficient and the residence time will be determined by the N target only.

For example, assume that a process is designed to obtain a product containing 800 ppm S (~90% HDS conversion) and 1000 ppm N (78.5% HDN conversion). With the all rim catalyst, this will be achieved in ~120 h. In these conditions, the desulfurization will have to be almost complete leading to S concentration of the order of a percent. This example and Example 4 clearly illustrate the feed dependence on the choice of the best catalyst.

Example 6

A Lube Oil Like Feed

This example is similar to Example 4. The same kinetics equations have been used and the feed heteroatom contents were 0.8 wt. % S and 0.1 wt. % N. All the other parameters, such as the adsorption constants and rate constants, were identical to that of Example 4.

Figure 9A:
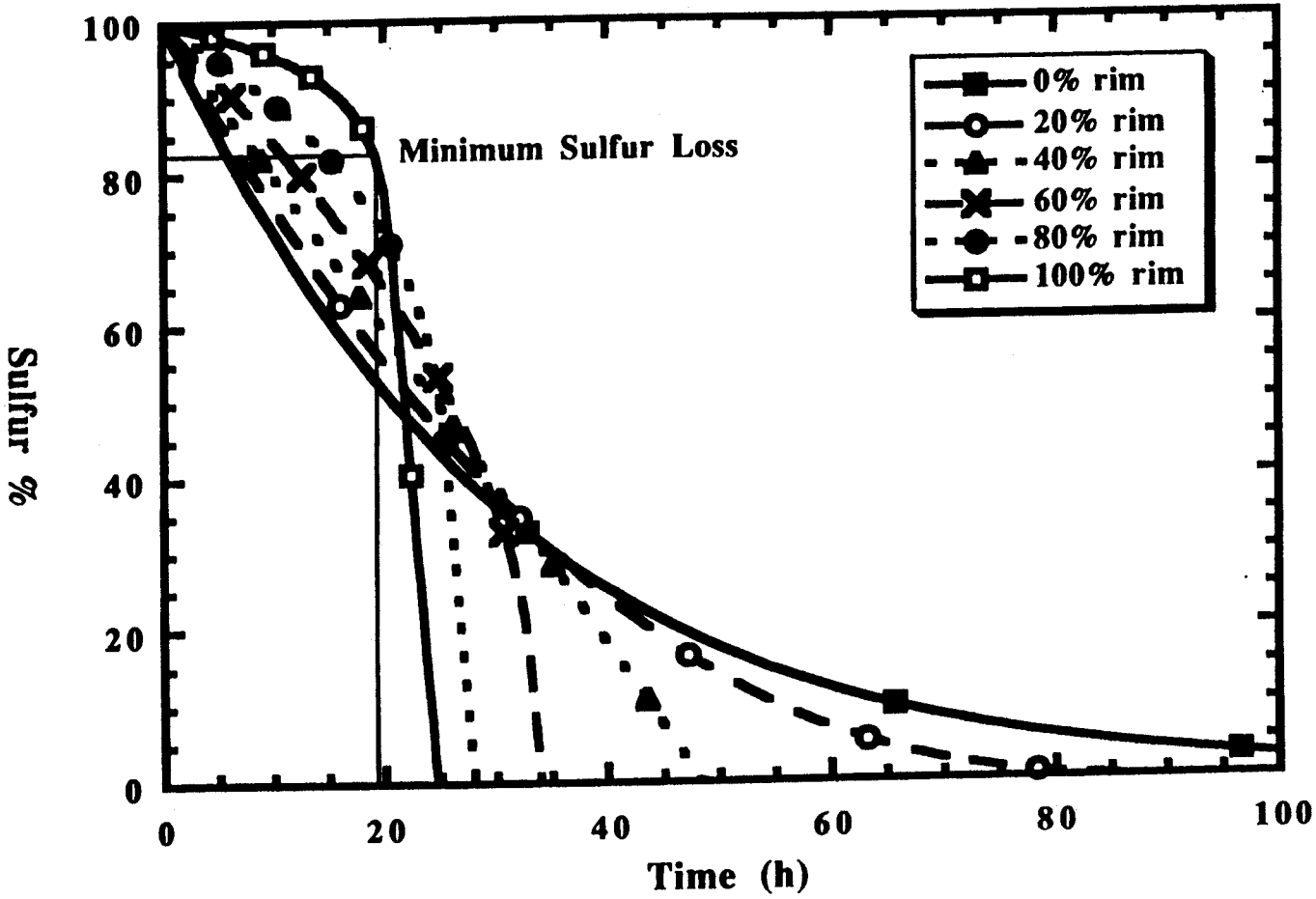
FIGS. 9*a* and 9*b* are similar to FIGS. 7*a* and 7*b*, but for a low nitrogen containing lube oil feedstock.
Figure 9B:
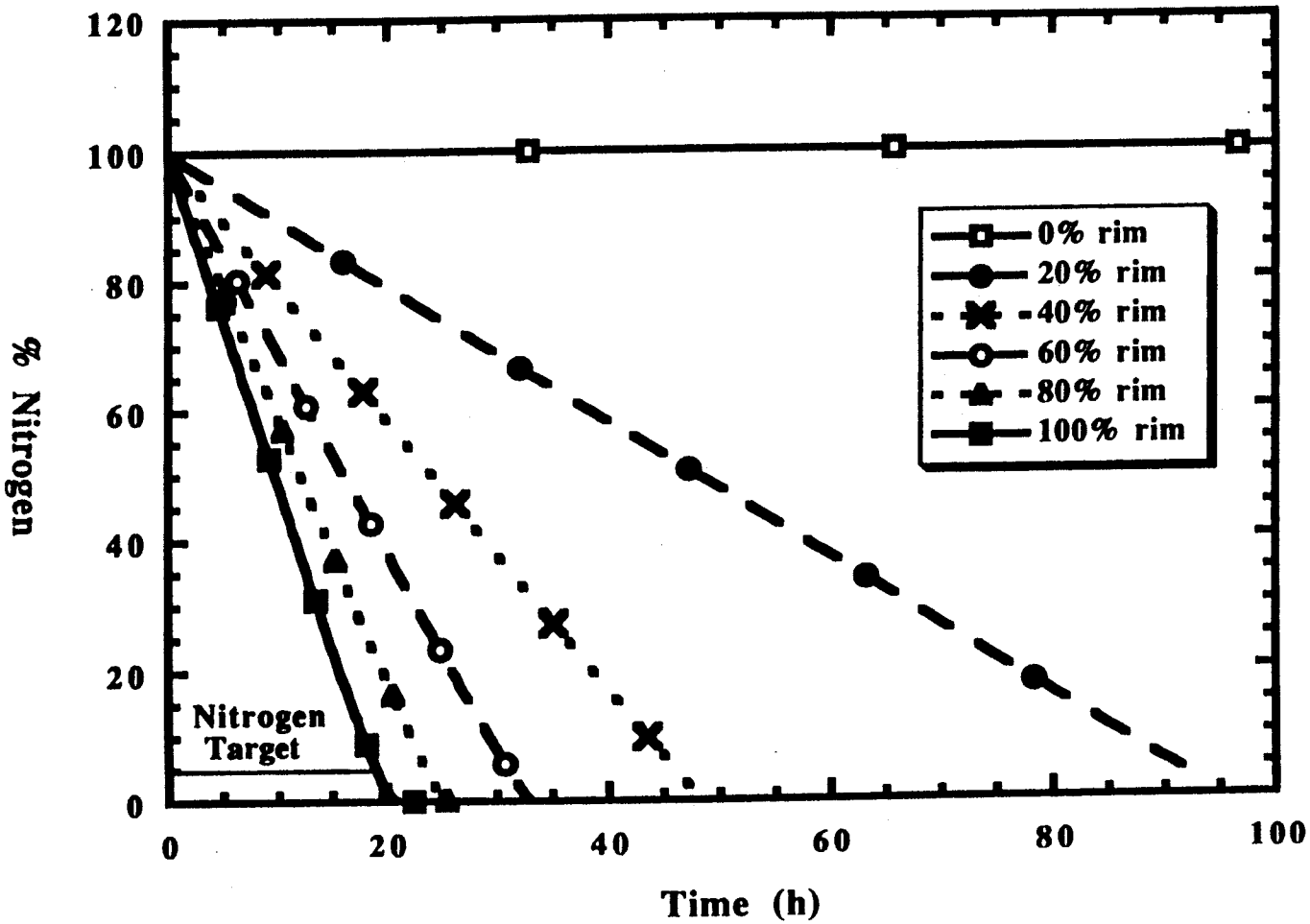

FIGS. 9*a* and 9*b* show the temporal variation of the kinetics for HDS and HDN for different relative concentration of rim sites. In the case of lube oil hydrotreating, it is suitable to remove most of the nitrogen; whereas, minimum HDS is required, since sulfur compounds have good lubricant properties.

For example, assume that a lube process is designed to obtain a product containing 50 ppm N (95% HDN conversion). With the all rim catalyst, this will be achieved in ~20 h without decreasing significantly the sulfur content. Only 17% HD conversion is obtained in these conditions.

What is claimed is:

1. In a hydrotreating process wherein a feedstock is contacted with a transition metal catalyst and hydrogen under hydrotreating conditions to provide a product having a lower sulfur and nitrogen content, the improvement comprising:

contacting the feedstock with a catalytic component selected from the group consisting of transition metal catalysts, a mixture of transition metal catalysts or a stacked bed of transition metal catalysts, the catalytic component having a pre-selected rim to edge ratio sufficient to provide a hydrotreated product with a predetermined sulfur and nitrogen content.

2. The improvement of claim 1 wherein the catalyst used in contacting the feedstock is selected by:

(1) determining the amount of sulfur and nitrogen to be lowered by hydrotreating the feedstock;

(2) determining the variation in the reaction kinetics for sulfur and nitrogen removal upon contacting the feedstock with catalysts of varying rim to edge ratios;

(3) selecting a residence time and a catalyst rim to edge ratio that is sufficient to provide a hydrotreated product with a predetermined sulfur and nitrogen content.

3. The improvement of claim 2 wherein the reaction kinetics are determined by integrating the Langmuir-Hinshelwood kinetic equations for hydrodesulfurization and hydrodenitrogenation.

4. The improvement of claim 3, including determining the relative adsorption constant for catalyst edge and rim sites and using the relative adsorption constants determined in determining the variation in the reaction kinetics for sulfur and nitrogen removal.

5. A method for hydrotreating a feedstock to lower the sulfur and nitrogen content therein comprising:

selecting the amount of sulfur and nitrogen to be removed from the feedstock;

determining a series of rates of sulfur and nitrogen removal, under hydrotreating conditions; using a transition metal catalyst, but having different rim to edge ratios, whereby each of the series of rates corresponds to a specific rim to edge ratio;

selecting a rate for sulfur and nitrogen removal from the series of rates determined;

providing a catalyst system selected from the group consisting of transition metal catalysts, mixtures thereof and a stacked bed of transition metal catalysts, the system having at least an average rim to edge ratio about the same as the rim to edge ratio corresponding to the rate selected for sulfur and nitrogen removal; and contacting the feedstock with hydrogen and the catalyst system under hydrotreating conditions.

6. The method of claim 4 wherein the catalyst system is a transition metal catalyst.

7. The method of claim 4 wherein the catalyst system is a stacked bed of transition metal catalysts.

8. The method of claim 4 wherein the catalyst system is a mixture of transition metal catalysts.

9. The method of claim 4 wherein the selected rate for sulfur and nitrogen removal results are such that the amount of hydrogen consumed is minimized.

10. The method of claim 4 wherein the selected rate for sulfur and nitrogen removal is a maximum.

* * * * *